US005945376A

United States Patent [19]

Burns et al.

[11] Patent Number: 5,945,376

[45] Date of Patent: Aug. 31, 1999

[54] THERMAL DYE TRANSFER ASSEMBLAGE WITH LOW TG POLYMERIC RECEIVER MIXTURE

[75] Inventors: Elizabeth G. Burns; Kristine B. Lawrence; John DiCillo; Ricky G. Frazier, all of Rochester; Daniel J. Harrison, Pittsford; Shandralynn Joiner, Rochester, all of N.Y.

[73] Assignee: Eastman Kodak Company, Rochester, N.Y.

[21] Appl. No.: 09/098,996

[22] Filed: Jun. 17, 1998

[51] Int. Cl.[6] ..... B41M 5/035; B41M 5/38

[52] U.S. Cl. ..... 503/227; 428/195; 428/480; 428/500; 428/704; 428/913; 428/914

[58] Field of Search ..... 8/471; 428/195, 428/480, 500, 704, 913, 914; 503/227

[56] References Cited

U.S. PATENT DOCUMENTS 4,871,715 10/1989 Harrison et al. ..... 503/227

*Primary Examiner*—Bruce H. Hess
*Attorney, Agent, or Firm*—Harold E. Cole

[57] ABSTRACT

A thermal dye transfer assemblage comprising:

(I) a dye-donor element comprising a support having thereon a dye layer comprising a dye dispersed in a polymeric binder, the dye being a deprotonated cationic dye which is capable of being reprotonated to a cationic dye having a N—H group which is part of a conjugated system, and (II) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising a mixture of a) a polymer having a Tg of less than about 19° C. and having no or only slight acidity; and b) an acidic material containing at least 0.0007 meq/$m^2$ of acid; the a) and/or b) having incorporated therein a plasticizer containing:

(i) at least the following groups in the order given:

E—Q—X—A wherein Q is a carbonyl or sulfonyl;
X is N or O;
E is an aromatic ring; and
A is an alkyl or oxyalky group having up to 5 consecutive carbon atoms; or (ii) a phosphate group having at least one aromatic ring attached thereto;

said plasticizer being present in an amount of up to about 25 weight percent of the polymer.

12 Claims, No Drawings

THERMAL DYE TRANSFER ASSEMBLAGE WITH LOW TG POLYMERIC RECEIVER MIXTURE

CROSS REFERENCE TO RELATED APPLICATIONS

Reference is made to commonly-assigned U.S. Pat. No. 5,358,958, entitled "Thermal Dye Transfer Assemblage With Low Tg Polymeric Receiver Mixture" by Landry-Coltrain et al; and U.S. Pat. No. 5,804,531, entitled "Thermal Dye Transfer Assemblage With Polyester Ionomer Receiver" by Evans et al, the teachings of which are incorporated herein by reference.

FIELD OF THE INVENTION

This invention relates to a thermal dye transfer receiver element of a thermal dye transfer assemblage and, more particularly, to a polymeric dye image-receiving layer containing a mixture of materials capable of reprotonating a deprotonated cationic dye transferred to the receiver from a suitable donor.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders such as poly(vinyl chloride), generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

DESCRIPTION OF RELATED ART

U.S. Pat. No. 4,871,715 relates to a dye receiving element for thermal dye transfer wherein a polymeric dye image-receiving layer contains a phthalate ester to improve dye density transfer. However, there is no disclosure in this patent that these esters have any effect when used with a deprotonated cationic dye.

It is an object of this invention to provide an assemblage wherein the dye-receiver element contains a material which increases the rate of protonation of a deprotonated cationic dye which has been transferred to the dye-receiver element.

SUMMARY OF THE INVENTION

This and other objects are achieved in accordance with this invention which relates to a thermal dye transfer assemblage comprising:

(I) a dye-donor element comprising a support having thereon a dye layer comprising a dye dispersed in a polymeric binder, the dye being a deprotonated cationic dye which is capable of being reprotonated to a cationic dye having a N—H group which is part of a conjugated system, and (II) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising a mixture of a) a polymer having a Tg of less than about 19° C. and having no or only slight acidity; and b) an acidic material containing at least 0.0007 meq/$m^2$ of acid; the a) and/or b) having incorporated therein a plasticizer containing:

(i) at least the following groups in the order given:

E—Q—X—A wherein Q is a carbonyl or sulfonyl;
X is N or O;
E is an aromatic ring; and
A is an alkyl or oxyalky group having up to 5 consecutive carbon atoms; or (ii) a phosphate group having at least one aromatic ring attached thereto;

the plasticizer being present in an amount of up to about 25 weight percent of the polymer.

DESCRIPTION OF THE PREFERRED EMBODIMENTS

It has been found that dye-receiving elements containing a mixture of an acidic material described herein in combination with a low Tg polymer and a plasticizer as described are effective at increasing the rate of protonation of basic dyes thermally transferred to the receiver.

The acidic material containing at least 0.0007 meq/$m^2$ of acid used in the invention can be a polymeric material or an organic or inorganic material. Examples of useful materials include the following:

1. an organic polymeric acid containing a sulfonic, phosphoric or carboxylic acid as disclosed in U.S. Pat. No. 5,627,128;
2. a hydrated transition metal or metalloid salt of a strong acid as disclosed in U.S. Pat. No. 5,786,300;
3. an acidic clay as disclosed U.S. Ser. No. 08/878,717 filed Jun. 19, 1997 by Harrison et al.;
4. a water-soluble, multifunctional carboxylic acid with at least two carboxylic acid groups attached as disclosed in U.S. Pat. No. 5,786,299;
5. a polymeric acid with a saturated hydrocarbon backbone as disclosed in U.S. Pat. No. 5,733,846;
6. an acidic salt formed by the reaction of a weak, nitrogen-containing base with a strong protic acid dissolved or dispersed in a polymeric binder as disclosed in U.S. Ser. No. 08/995,689 filed Dec. 22, 1997 by Burns et al.;
7. a polyester which has been polymerized in the presence of an aluminum salt and which contains an aluminum ion as disclosed in copending U.S. Ser. No. 09/035709 filed Mar. 5, 1998 of Burns et al.; and
8. an organic acid moiety as part of a polymer chain as disclosed in U.S. Pat. Nos. 5,523,274 and 5,534,479.

In a preferred embodiment of the invention, the acidic material is a polyester ionomer having the following general formula:

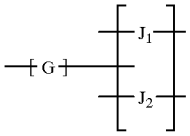

wherein:

G is the residue of one or more diol components which together comprise 100 mole % of recurring units and is represented by the following structure:

$$—O—(CHR_4CHR_5B_1)_p—R_6—(OCHR_4CHR_5)_q—O—$$

wherein:

p and q each independently represents an integer from 0–4; $R_6$ represents an alkylene group of 1 to about 16 carbon atoms; a cycloalkylene group of 5 to about 20 carbon atoms; a cyclobisalkylene group of about 8 to about 20 carbon atoms; a bi- or tri-cycloalkylene group of about 7 to about 16 carbon atoms; a bi- or tri-cyclobisalkylene group of about 9 to about 18 carbon atoms, an arenebisalkylene group of from 8 to about 20 carbon atoms, or an arylene group of from 6 to about 12 carbon atoms; and $R_4$ and $R_5$ each independently represents H, a substituted or unsubstituted alkyl group of about 1 to about 6 carbon atoms, or a substituted or unsubstituted aryl group of about 6 to about 12 carbon atoms;

$B_1$ represents O or S;

$J_1$ represents the residue of a diacid component which comprises 8 to 30 mole % of recurring units and is represented by one or more of the following structures:

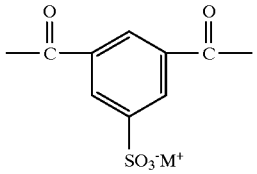

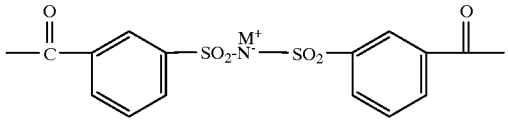

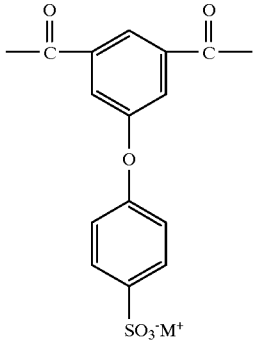

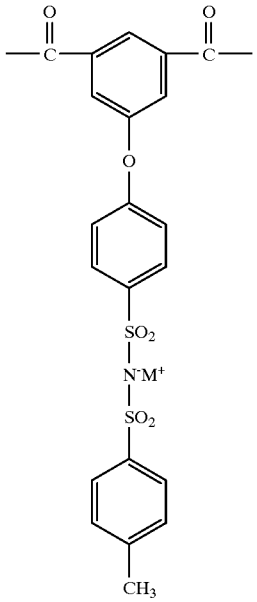

wherein:

$M^+$ represents the protonated or conjugate acid form of a basic, nitrogen-containing moiety having a pKa measured in water of from about 6 to about 10; and $J_2$ represents the residue of a diacid component which comprises 70 to 92 mole % of recurring units and is represented by one or more of the following structures:

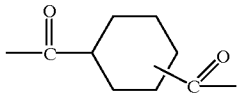

-continued

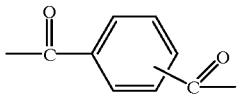

or

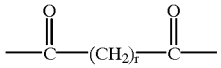

where r represents an integer from 2 to 10.

Some typical diols corresponding to G above include ethylene glycol, diethylene glycol, triethylene glycol, thiodiethanol, cyclohexanedimethanol, bisphenol A, trans-1,4-cyclohexanediol, dodecanediol, cis-exo-2,3-norbornanediol, 5-norbomene-2,2-dimethanol, etc.

The acidic polyester ionomer which may be employed in the invention preferably has a Tg between about −50° C. and 100° C. Higher Tg polyesters may be useful with added plasticizer. In a preferred embodiment of the invention, the polyesters have a number average molecular weight of from about 10,000 to about 250,000 more preferably from 20,000 to 100,000.

Examples of acidic polyester ionomers which may be employed in the invention include the following:

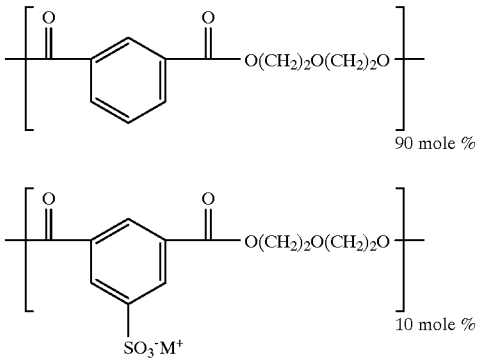

| Polyester Ionomer No. | $M^+$ |
|---|---|
| P-1 | $NH_4^+$ |
| P-2 | $NH(C_2H_4OH)_3^+$ |
| P-3 | 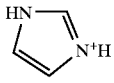 |
| P-4 | 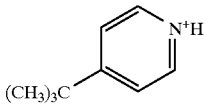 |

The acidic material in the dye image-receiving layer of the assemblage of the invention may be present in any amount which is effective for its intended purpose. In general, good results have been obtained at a concentration of from about 0.5 to about 10 g/m$^2$. The polymers may be coated from organic solvents or water, if desired.

In a preferred embodiment of the invention, the deprotonated cationic dye employed in the invention and the corresponding cationic dye having a N—H group which is part of a conjugated system have the following structures:

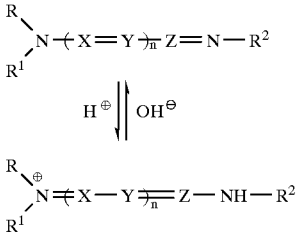

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents a substituted or unsubstituted phenyl or naphthyl group or a substituted or unsubstituted alkyl group from about 1 to about 10 carbon atoms; and n is an integer of from 0 to 11.

The deprotonated cationic dyes according to the above formula are disclosed in U.S. Pat. Nos. 4,880,769, 4,137,042 and 5,559,076, and in K. Venkataraman ed., *The Chemistry of Synthetic Dyes*, Vol. IV, p. 161, Academic Press, 1971, the disclosures of which are hereby incorporated by reference. Specific examples of such dyes include the following (the λ max values and color descriptions in parentheses refer to the dye in its protonated form):

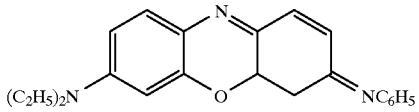

Dye 1
λ max 556 nm (641 nm)
magenta (cyan)
U.S. Pat. No. 4,880,769 (Dye 1)

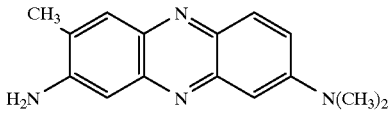

Dye 2
λ max 459 nm (536 nm)
yellow (magenta)

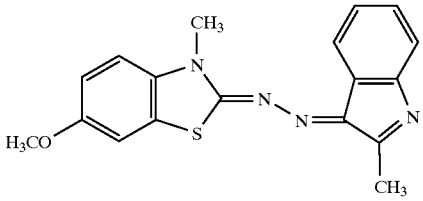

Dye 3
λ max 459 nm (522 nm)
yellow (magenta)

-continued

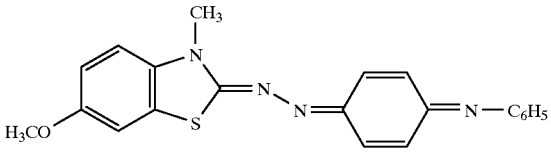

Dye 4
λ max 503 nm (621 nm)
red (blue)

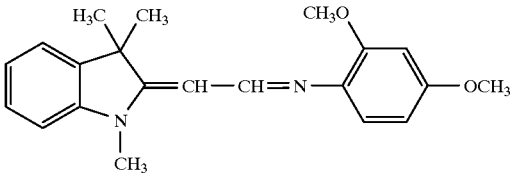

Dye 5
λ max 379 nm (405 nm)
yellow (yellow)

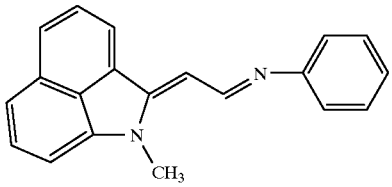

Dye 6
λ max 479 nm (513 nm)
yellow (magenta)

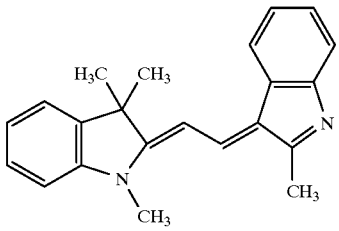

Dye 7
λ max 485 nm (495)
yellow (yellow)

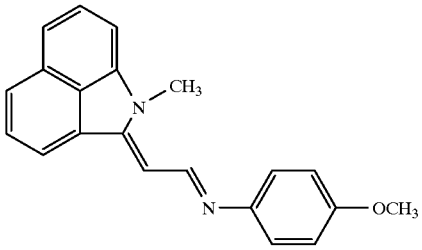

Dye 8
yellow (magenta)
U.S. Pat. No. 5,559,076 (dye precursor 5)

The dyes described above may be employed in any amount effective for the intended purpose. In general, good results have been obtained when the dye is present in an amount of from about 0.05 to about 1.0 g/m$^2$, preferably from about 0.1 to about 0.5 g/m$^2$. Dye mixtures may also be used.

In a preferred embodiment of the invention, the polymer having a Tg of less than about 19° C. can be an acrylic, styrene, polyester or vinyl polymer or mixtures thereof. Following are examples of low Tg polymers that may be used in the invention:

Polymer A: poly(butyl acrylate-co-allyl methacrylate) 98:2 wt core/poly(glycidyl methacrylate) 10 wt shell, (Tg=−40° C.)

Polymer B: poly(butyl acrylate-co-allyl methacrylate) 98:2 wt core/poly(ethyl methacrylate) 30 wt shell, (Tg=−41° C.)

Polymer C: poly(butyl acrylate-co-allyl methacrylate) 98:2 wt core/poly(2-hydroxypropyl methacrylate) 10 wt shell, (Tg=−40° C.)

Polymer D: poly(butyl acrylate-co-ethylene glycol dimethacrylate) 98:2 wt core/poly(glycidyl methacrylate 10 wt shell, Tg=−42° C.)

Polymer E: poly(butyl acrylate-co-allyl methacrylate-co-glycidyl methacrylate) 89:2:9 wt, (Tg=−34° C.)

Polymer F: poly(butyl acrylate-co-ethylene glycol dimethacrylate-co-glycidyl methacrylate) 89:2:9 wt (Tg=−28° C.)

Polymer G: poly(butyl methacrylate-co-butyl acrylate-co-allyl methacrylate) 49:49:2 wt core/poly(glycidyl methacrylate) 10 wt shell, (Tg=18° C.)

Polymer H: poly(methyl methacrylate-co-butyl acrylate-co-2-hydroxyethyl methacrylate-co-2-sulfoethyl methacrylate sodium salt) 30:50:10:10 wt, (Tg=−3° C.)

Polymer I: poly(methyl methacrylate-co-butyl acrylate-co-2-hydroxyethyl methacrylate-co-styrene sulfonic acid sodium salt) 40:40:10:10 wt, (Tg=0° C.)

Polymer J: poly(methyl methacrylate-co-butyl acrylate-co-2-sulfoethyl methacrylate sodium salt-co-ethylene glycol dimethacrylate) 44:44:10:2 wt, (Tg=14° C.)

Polymer K: poly(butyl acrylate-co-Zonyl TM®-co-2-acrylamido-2-methyl-propanesulfonic acid sodium salt) 50:45:5 wt (Tg=−39° C.) (Zonyl TM® is a monomer from the DuPont Company)

Polymer L: XU31066.50 (experimental polymer based on a styrene butadiene copolymer from Dow Chemical Company) (Tg=−31° C.)

Polymer M: AC540® nonionic emulsion (Allied Signal Co.) (Tg=−55° C.)

Polymer N: a polyester having the formula:

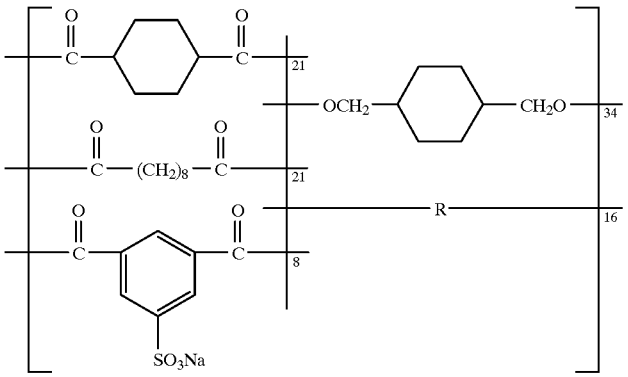

wherein R is polyethylene glycol having a molecular weight of 200, the polyester having a Tg of −22° C.

The polymer in the dye image-receiving layer may be present in any amount which is effective for its intended purpose. In general, good results have been obtained at a concentration of from about 0.5 to about 20 g/m$^2$. The polymers may be coated from organic solvents or water, if desired.

As noted above, the plasticizer that is incorporated into the polyester ionomer and/or low Tg polymer in the invention has (i) at least the following groups in the order given:

E—Q—X—A wherein Q is a carbonyl or sulfonyl;

X is N or O;

E is an aromatic ring, such as benzene, toluene, xylene, nitrobenzene, naphthalene, chlorobenzene, etc; and A is an alkyl or oxyalky group having up to 5 consecutive carbon atoms, such as methyl, ethyl, isopropyl, propyl, butyl, t-butyl, pentyl, neopentyl, cyclopentyl; s-butyl, methoxymethyl, ethoxyethyl, propoxyethyl, butoxybutyl; or (ii) a phosphate group having at least one aromatic ring attached thereto, such as triphenyl phosphate, t-butyl diphenyl phosphate, diethylphenyl phosphate, etc.

Specific examples of such plasticizers include the following:

I-1: diethylene glycol dibenzoate, Scientific Polymer Products, Inc.

I-2: N-ethyl-o,p-toluene sulfamide, Scientific Polymer Products, Inc.

I-3: ethylene glycol dibenzoate, Scientific Polymer Products, Inc.

I-4: dimethyl phthalate, Scientific Polymer Products, Inc.

I-5: t-butyl phenyl diphenyl phosphate, Scientific Polymer Products, Inc.

I-6: dipropylene glycol dibenzoate, Scientific Polymer Products, Inc.

The plasticizer may be present in an amount up to about 25% of the polymer, preferably about 5–10%.

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal print heads. Such materials include polyesters such as poly (ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of deprotonated dyes, as described above, capable of generating a cyan, magenta and yellow dye and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

When a three-color image is to be obtained, the assemblage described above is formed on three occasions during the time when heat is applied by the thermal print head. After the first dye is transferred, the elements are peeled apart. A second dye-donor element (or another area of the donor element with a different dye area) is then brought into register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

Preparation of Polymers and Polymers+Plasticizers

Preparation of P-1:

Dowex® 50W-X8(Na) ion exchange resin(1 kg) was treated with 800 mL of saturated ammonium chloride ($NH_4Cl_2$) solution. The resin was then rinsed with water until a 5% solution of silver nitrate when added to the filtrate no longer precipitated. The treated resin was then added to 4 L of AQ29D® polyester dispersion (Eastman Chemical Co.). The slurry was stirred overnight at room temperature. The resin was removed by filtration, then rinsed with 500 mL of water. The resin was then rinsed until the filtrate was clear. The resin was retreated with ammonium chloride, as described above. The freshly treated resin was re-added to the previously treated dispersion and, the slurry was stirred overnight at room temperature. The resin was remove by filtration and rinsed with 500 mL of water. The dispersion contained 29.5% solids and ammonium ($NH_4^+$) content by titration of 0.448 meq/g.

Preparation of Polymer A:

To a 12 L 3-neck flask fitted with a stirrer and condenser were added 2400 mL degassed distilled water, 26.8 mL 45% Dowfax® 2A1 surfactant (Dow Chemical Co.) and 8 g sodium carbonate. The flask was heated to 80° C. Subsequently, 4,4'-azobis(4-cyanovaleric acid) (16 g 80% aqueous solution) was added followed by the contents from an addition flask containing 2400 mL degassed distilled water, 26.8 mL 45% Dowfax® 2A1 surfactant, 1176 g butyl acrylate and 24 g allyl methacrylate over a period of two hours. The pH of the resulting latex was adjusted to 7 with acetic acid, and the latex was stirred at 80° C. for one hour. Subsequently, 4,4'-azobis(4-cyanovaleric acid) (0.6 g 80% aqueous solution) was added followed by the contents from an addition flask containing 480 mL degassed distilled water, 18 mL 45% Dowfax® 2A1 surfactant, 120 g glycidyl methacrylate over a period of 90 min. The resulting latex was stirred at 80° C. for 2 hours and then cooled to 25° C. The pH was adjusted to 7 with acetic acid. The latex contained 19.9% solids and had a particle size of 92.8 nm and a Tg of −40° C.

Preparation of Polymer A+Plasticizer (I-1):

To a 1 L 3-neck flask fitted with a stirrer and condenser were added 400 mL degassed distilled water, 4.5 mL 45% Dowfax® 2A1 surfactant (Dow chemical) and 1.3 g sodium carbonate. The flask was heated to 80° C. Subsequently, 4,4'-azobis(4-cyanovaleric acid) (2.7 g 80% aqueous solution) was added followed by the contents from an addition flask. The contents of the addition flask were prepared by dissolving 11 g of diethylene glycol dibenzoate (5 wt % of total monomers) in a mixture of 196 g, 1.53 mole of butyl acrylate and 4 g, 0.031 mole of allyl methacrylate, then adding this mixture to 400 mL of degassed water and 4.5 mL of 45% Dowfax® 2A1. The contents of the addition flask were added over a 2 hour period. The pH of the resulting latex was adjusted to 7 with acetic acid, and the latex was stirred at 80° C. for one hour. Subsequently, 4,4'-azobis(4-cyanovaleric acid) (0.6 g 80% aqueous solution) was added followed by the contents from an addition flask containing 80 mL degassed distilled water, 3 mL 45% Dowfax® 2A1 surfactant, 20 g, 0.139 mole glycidyl methacrylate over a period of 90 min. The resulting latex was stirred at 80° C. for 2 hours and then cooled to 25° C. The pH was adjusted to 7 with acetic acid. The latex contained 19.4% solids and had a particle size of 41 nm. Plasticizers I-2 through I-6 were incorporated into Polymer A in the same manner as described above.

Following are control plasticizers used in the examples:

CI-1: dicyclohexyl phthalate, Scientific Polymer Products, Inc.

CI-2: dioctyl phthalate, Scientific Polymer Products, Inc.

CI-3: glyercol triacetate, Scientific Polymer Products, Inc.

Control Plasticizers CI-1 through CI-3 were incorporated into Polymer A in the same manner as described above.

Preparation of P-1+Plasticizer (I-1):

The plasticizer solution (50% solid in $CH_2Cl_2$) was combined with the AQ29$NH_4^+$ dispersion (30% solid) in a four dram scintillation vial. The ratio of plasticizer solution to polymer dispersion was chosen in order that the ratio of plasticizer to polymer was (5:95), (10:90), (15:85) and (20:80). The mixtures were allowed to stir overnight at room temperature. The following day, the mixtures were allowed to stand without stirring throughout the morning and observed for any signs of coagulation in the afternoon. Each mixture appeared homogeneous. Subsequently, each plasticizer/dispersion mixture was prepared on the 200 mL dispersion scale.

Preparation of P-1+Plasticizer (I-2):

The plasticizer solution (50% in tetrahydrofuran) was combined with AQ29$NH_4^+$ dispersion (30% solid) in the same manner as indicated for I-1. The work-up for the plasticizer/dispersion mixture is the same as that above.

Preparation of P-1+Plasticizer (I-3):

The plasticizer solution (20% in tetrahydrofuran) was combined with AQ29$NH_4^+$ dispersion (30% solid) in similar manner as above. However, the ratios of plasticizer to polymer were 5:95 and 10:90.

Preparation of P-1+Plasticizer (I-4):

The plasticizer solution (10% in isopropanol) was combined with AQ29$NH_4^+$ dispersion (30% solid) in same manner as above. However, the ratio of plasticizer to polymer was only 10:90.

Preparation of P-1+Plasticizer (I-5):

The plasticizer solution (10% in isopropanol) was combined with $AQ29NH_4^+$ in same manner as indicated for plasticizer I-4.

Preparation of P-1+Plasticizer (I-6):

The plasticizer solution (10% in methylene chloride) was combined with $AQ29NH_4^+$ in same manner as indicated for plasticizer I-4.

Preparation of P-1+Control Plasticizer CI-1

The plasticizer solution (20 wt. % in ethyl acetate) was combined with $AQ29NH_4^+$ in same manner as indicated for plasticizer I-4.

Example 2

Preparation and Evaluation of Thermal Dye Transfer Images

Preparation of Dye-Donor Elements

Dye Donor Element 1:

Individual dye-donor elements were prepared by coating the following compositions in the order listed on a 6 μm poly(ethylene terephthalate) support:

1) a subbing layer of Tyzor TBT®, a titanium tetrabutoxide, (DuPont Company) (0.16 g/m$^2$) coated from 1-butanol/propyl acetate (15/85 wt. %); and
2) a dye layer containing 0.28 g/m$^2$ of Dye 5, a mixture of 0.13 g/m$^2$ each of cellulose acetate propionates 482-.5 and 482-20 (Eastman Chemical Company), 0.07 g/m$^2$ of poly(butyl methacrylate-co-Zonyl TM®) (75:25) where Zonyl TM® is a fluorinated acrylate monomer (DuPont Chemical Co.), 0.01 g/m$^2$ of Paraplex® G25 (a polyester sebacate) (C.P. Hall Company) and 0.01 g/m$^2$ of 2,4,6-trimethylanilid of phenylindandicarboxylic acid (CAS Reg. No. 156081-22-0) coated from a mixture of toluene, methanol and cylcohexanone (70:25:5).

Dye Donor Element 2 was coated exactly as described for Dye Donor Element 1 except the dye layer contained 0.16 g/m$^2$ of Dye 1, a mixture of 0.086 g/m$^2$ each of cellulose acetate propionates 482-.5 and 482-20, 0.04 g/m$^2$ of poly (butyl methacrylate-co-Zonyl TM®) (75:25) and 0.02 g/m$^2$ of Paraplex® G25 coated from a mixture of toluene, methanol and cylcohexanone (70:25:5).

On the back side of the dye-donor elements were coated the following compositions in the order listed:

1) a subbing layer of Tyzor TBT®, a titanium tetrabutoxide, (DuPont Company) (0.16 g/m$^2$) coated from 1-butanol; and
2) a slipping layer of 0.38 g/m$^2$ of poly(vinyl acetal) (Sekisui), 0.022 g/m$^2$ Candelilla wax dispersion (7% in methanol), 0.011 g/m$^2$ PS513 amino-terminated polydimethylsiloxane (Huels) and 0.0003 g/m$^2$ of p-toluenesulfonic acid coated from a 3-pentanone/distilled water (98/2) solvent mixture.

Preparation of Dye-Receiving Elements

Control Receiver Element C-1:

This element was prepared by first extrusion laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of Prosil® 221 (aminopropyl triethoxysilane) and 2210 (an aminofunctional epoxysilane) (0.05 g/m$^2$ each), (both available from PCR, Inc.) coated from 3A alcohol]; (PCR, Inc.); and
2) a dye-receiving layer of 2.42 g/m$^2$ of P-1, 4.30 g/m$^2$ of Polymer A and 0.022 g/m$^2$ of Fluorad® FC-170 fluorocarbon surfactant coated from distilled water.

Control Receiver Element C-2:

This element was prepared as described above for Control Receiver Element C-1, except the dye receiving layer was composed of 2.67 g/m$^2$ of P-1 where 10 wt. % CI-1 plasticizer was incorporated into P-1, 4.06 g/m$^2$ of Polymer A and 0.022 g/m$^2$ of Fluorad® FC-170 fluorocarbon surfactant coated from distilled water.

Receiver Elements 1 through 6 of the Invention:

Receiver Elements 1–6 were prepared as described above for Control Receiver Element C-1, except the dye receiving layer was composed of 2.67 g/m$^2$ of P-1 where 10 wt. % of a given plasticizer was incorporated into P-1, 4.06 g/m$^2$ of Polymer A and 0.022 g/m$^2$ of Fluorad® FC-170 fluorocarbon surfactant coated from distilled water. The plasticizers that were incorporated into P-1 are listed in Table 1 below.

Control Receiver Elements C-3 through C-4:

These elements were prepared as described above for Control Receiver Element C-1, except the dye receiving layer was composed of 2.42 g/m$^2$ of P-1, 4.30 g/m$^2$ of Polymer A where 10 wt. % of either CI-2 or CI-3 were incorporated into Polymer A and 0.022 g/m$^2$ of Fluorad® E FC-170 fluorocarbon surfactant coated from distilled water.

Receiver Elements 7 through 11 of the Invention:

Receiver Elements 7–11 were prepared as described above for Control Receiver Element C-1, except the dye receiving layer was composed of 2.42 g/m$^2$ of P-1, 4.30 g/m$^2$ of Polymer A where 10 wt. % of a given plasticizer was incorporated into Polymer A and 0.022 g/m$^2$ of Fluorad® FC-170 fluorocarbon surfactant coated from distilled water. The plasticizers that were incorporated into Polymer A are listed in the following table:

TABLE 1

| Receiver Element | Polymer Containing Plasticizer | Plasticizer |
|---|---|---|
| 1 | P-1 | I-1 |
| 2 | P-1 | I-2 |
| 3 | P-1 | I-3 |
| 4 | P-1 | I-4 |
| 5 | P-1 | I-5 |
| 6 | P-1 | I-6 |
| C-2 | P-1 | CI-1 |
| 7 | Polymer A | I-1 |
| 8 | Polymer A | I-2 |
| 9 | Polymer A | I-4 |
| 10 | Polymer A | I-5 |
| 11 | Polymer A | I-6 |
| C-3 | Polymer A | CI-2 |
| C-4 | Polymer A | CI-3 |

Evaluation of Thermal Dye Transfer Images:

Eleven-step sensitometric cyan thermal dye transfer images were prepared from the above dye-donor and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head (TDK No. 8I0625 with a resolution of 5.4 dots/mm, thermostatted at 25° C.) was pressed with a force of 24.4 Newton (2.5 kg) against the dye donor element side of the assemblage, pushing it against the rubber roller.

The imaging electronics were activated causing the donor-receiver assemblage to be drawn through the print head/roller nip at 40.3 mm/sec. Coincidentally, the resistive elements in the thermal print head were pulsed for 127.75 μs/pulse at 130.75 μs intervals during a 4.575 msec/dot printing cycle (including a 0.391 msec/dot cool-down interval). A stepped image density was generated by incrementally increasing the number of pulses/dot from a minimum of 0 to a maximum of 32 pulses/dot. The voltage supplied to the thermal head was approximately 12.5 v resulting in an instantaneous peak power of 0.294 watts/dot and a maximum total energy of 1.20 mJ/dot. This procedure was done using a cyan donor to produce a cyan stepped image. Print room humidity: 31% RH.

For images containing a cyan dye (cyan or green images), protonation causes a color change from the deprotonated dye form (magenta) to the protonated dye form (cyan). This color change can be monitored by measuring status A red (cyan) and green (magenta) densities at various time intervals and calculating the red/green ratio as a fuiction of time.

After printing, the dye-donor element was separated from the imaged receiving element and the Status A reflection red and green densities at step 10 in the stepped-image were measured for the green image using an X-Rite 820® Reflection Densitometer (X-Rite Corp.) after 30 minutes at room temperature. The prints were then placed into a 50° C./50% RH oven for 3 hours and the red and green densities were reread. A red/green (R/G) ratio (minus the baseline) was calculated for the cyan dye in the green image in each receiver at the above mentioned time interval and the % dye conversion for the green image was calculated assuming the incubated R/G ratios represented 100% dye conversion. The results are summarized in Table 2 below.

TABLE 2

| Receiver Element | R/G Ratio, 30 min. R.T. | R/G Ratio, 3 Hours, inc. | % Dye Conv. 30 min. |
|---|---|---|---|
| 1 | 3.93 | 5.55 | 71% |
| 2 | 4.17 | 5.64 | 74% |
| 3 | 3.17 | 5.59 | 57% |
| 4 | 3.44 | 5.61 | 61% |
| 5 | 3.21 | 5.64 | 57% |
| 6 | 3.16 | 5.31 | 59% |
| 7 | 4.27 | 5.43 | 79% |
| 8 | 3.76 | 5.39 | 70% |
| 9 | 3.52 | 5.59 | 63% |
| 10 | 2.89 | 5.68 | 51% |
| 11 | 3.22 | 5.62 | 57% |
| C-1 | 2.50 | 5.47 | 46% |
| C-2 | 2.54 | 5.38 | 47% |
| C-3 | 2.52 | 5.50 | 47% |
| C-4 | 2.72 | 5.59 | 49% |

The above results show that receiver elements that contained plasticizers I-1 through I-6 in either P-1 (1 through 6) or Polymer A (7 through 11) showed an improved rate of protonation relative to the control receiver element that did not contain a plasticizer (C-1). Receiver elements containing Cl-1 through CI-3 plasticizers (C-2 through C-4) showed very little improvement in rates of protonation relative to the control receiver element that did not contain a plasticizer (C-1).

Example 3

Level Series of Plasticizers in P-1

Control Receiver Element C-5:

This element was prepared as described for C-1 in Example 2 above except the dye receiving layer was a mixture of 2.46 g/m$^2$ of P-1, 4.26 g/m$^2$ of Polymer A and 0.022 g/m$^2$ of Fluorad® FC-170 fluorocarbon surfactant coated from distilled water.

Receiver Elements 12 through 19:

Receiver Elements 12–19 were prepared as described above for Control Receiver Element C-5, except the dye receiving layer was composed of a mixture of P-1, Polymer A and 0.022 g/m$^2$ of Fluorad® FC-170 fluorocarbon surfactant coated from distilled water. The I-1 and I-2 plasticizers were incorporated into P-1 at levels ranging from 5 wt. % to 20 wt. %. The corresponding dry laydowns of P-1 for each of these receiver elements were adjusted to keep the level of acidity in each equivalent to C-2. The dry laydowns for P-1 and Polymer A are as follows:

TABLE 3

| Receiver Element | Plasticizer | Level of Plasticizer in P-1, wt. % | g/m$^2$ of P-1 | g/m$^2$ of Polymer A |
|---|---|---|---|---|
| 12 | I-1 | 5% | 2.58 | 4.15 |
| 13 | I-1 | 10% | 2.71 | 4.01 |
| 14 | I-1 | 15% | 2.83 | 3.90 |
| 15 | I-1 | 20% | 2.96 | 3.77 |
| 16 | I-2 | 5% | 2.58 | 4.15 |
| 17 | I-2 | 10% | 2.71 | 4.01 |
| 18 | I-2 | 15% | 2.83 | 3.90 |
| 19 | I-2 | 20% | 2.96 | 3.77 |

Thermal dye transfer prints were prepared as described in Example 2, except the print room humidity was 26% RH. The following results were obtained:

TABLE 4

| Receiver Element | R/G Ratio, 30 min. R.T. | R/G Ratio, 3 Hours, inc. | % Dye Conv. 30 min. |
|---|---|---|---|
| 12 | 3.25 | 5.48 | 59% |
| 13 | 3.93 | 5.55 | 71% |
| 14 | 4.78 | 5.58 | 86% |
| 15 | 4.78 | 5.56 | 86% |
| 16 | 3.20 | 5.38 | 60% |
| 17 | 4.12 | 5.27 | 78% |
| 18 | 4.76 | 5.31 | 90% |
| 19 | 4.70 | 5.39 | 87% |
| C-5 | 2.65 | 5.41 | 49% |

The above results show that the addition of either I-1 or I-2 plasticizers in P-1 (receiver elements 12 through 19) at levels ranging from 5 wt. % to 20 wt. % showed improved dye protonation (conversion) rates relative to the control receiver element C-5 that did not contain a plasticizer.

Example 4

Level Series of Plasticizers in Polymer A

Receiver Elements 20 through 23:

Receiver elements 20 through 23 were prepared as described above for control receiver element C-2, except the dye receiving layer was composed of a mixture of 2.46 g/m$^2$ of P-1, 4.26 g/m$^2$ of Polymer A where either I-1 or I-2 plasticizer was incorporated into Polymer A at levels ranging between 5 wt. % and 25 wt. %, and 0.022 g/m$^2$ of Fluorad® FC-170 fluorocarbon surfactant coated from distilled water.

Control Receiver Elements C-6 through C-8 were prepared as described above for Receiver Elements 20–23 except that either I-1 or I-2 plasticizers were incorporated into Polymer A at levels ranging between 25 and 50% by weight.

The wt. % of each plasticizer present in the receiver elements and control receiver elements is summarized in the following table:

TABLE 5

| Receiver Element | Plasticizer | Level of Plasticizer in Polymer A, wt. % |
|---|---|---|
| 20 | I-1 | 5% |
| 21 | I-1 | 10% |
| 22 | I-1 | 25% |
| 23 | I-2 | 5% |
| 8 | I-2 | 10% |
| C-6 | I-1 | 50% |
| C-7 | I-2 | 25% |
| C-8 | I-2 | 50% |

Thermal dye transfer prints were prepared as described in Example 2, except the print room humidity was 33% RH. The following results were obtained:

TABLE 6

| Receiver Element | R/G Ratio, 30 min. R.T. | R/G Ratio, 3 Hours, inc. | % Dye Conv. 30 min. |
|---|---|---|---|
| 8 | 3.76 | 5.39 | 70 |
| 20 | 4.22 | 5.38 | 79 |
| 21 | 4.44 | 5.40 | 82 |
| 22 | 4.98 | 5.15 | 97 |
| 23 | 5.02 | 5.27 | 95 |
| C-5 | 3.30 | 4.86 | 68 |
| C-6 | * | * | * |
| C-7 | * | * | * |
| C-8 | * | * | * |

*donor element stuck to receiver element during printing and no data was obtained The above results show that the addition of plasticizer I-1 in Polymer A (receiver elements 20 through 22) or plasticizer I-2 in Polymer A (Receiver elements 8 and 23) showed improved dye protonation (conversion) rates relative to the control receiver element C-5 that did not contain a plasticizer. Receiver elements that contained I-1 at 50 wt. % (receiver element C-6) or I-2 at levels greater than 10 wt. % (control receiver elements C-7 through C-8) showed severe donor-receiver sticking during printing and data could not be generated.

Example 7

Addition of Plasticizers to Both P-1 and Polymer A Receiver Elements 24 through 25:

Receiver Elements 24–25 were prepared as described above for control receiver element C-5, except the dye receiving layer was composed of a mixture of P-1, Polymer A and 0.022 g/m$^2$ of Fluorad® FC-170 fluorocarbon surfactant coated from distilled water. Plasticizer I-3 was incorporated into P-1 and plasticizer I-1 was incorporated into Polymer A at both 5% and 10 wt. % levels. The corresponding dry laydowns for P-1 and Polymer A for these mixtures are as follows:

TABLE 7

| Receiver Element | Level of Plasticizer in P-1 and Polymer A, wt. % | g/m$^2$ of P-1 | g/m$^2$ of Polymer A |
|---|---|---|---|
| 24 | 5% | 2.54 | 4.19 |
| 25 | 10% | 2.67 | 4.06 |

Thermal dye transfer prints were prepared as described in Example 2, except the print room humidity was 31% RH. The following results were obtained:

TABLE 8

| Receiver Element | R/G Ratio, 30 min. R.T. | R/G Ratio, 3 Hours, inc. | % Dye Conv. 30 min |
|---|---|---|---|
| 24 | 3.14 | 5.39 | 58% |
| 25 | 3.94 | 5.21 | 76% |
| C-1 | 2.44 | 5.38 | 45% |

The above results show that the addition of plasticizers to both P-1 and Polymer A (receiver elements 24 and 25)) showed improved dye protonation (conversion) rates relative to the control receiver element C-1 that did not contain a plasticizer.

The invention has been described in detail with particular reference to preferred embodiments thereof, but it will be understood that variations and modifications can be effected within the spirit and scope of the invention.

What is claimed is:

1. A thermal dye transfer assemblage comprising:

(I) a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and (II) a dye-receiving element comprising a support having thereon a polymeric dye image-receiving layer, said dye-receiving element being in a superposed relationship with said dye-donor element so that said dye layer is in contact with said polymeric dye image-receiving layer, said polymeric dye image-receiving layer comprising mixture of a) a polymer having a Tg of less than about 19° C. and having no or only slight acidity; and b) an acidic material containing at least 0.0007 meq/m$^2$ of acid; said a) and/or b) having incorporated therein a plasticizer containing:

(i) at least the following groups in the order given:

E—Q—X—A wherein Q is a carbonyl or sulfonyl;

X is N or O;

E is an aromatic ring; and

A is an alkyl or oxyalky group having up to 5 consecutive carbon atoms; or (ii) a phosphate group having at least one aromatic ring attached thereto;

said plasticizer being present in an amount of up to about 25 weight percent of the polymer.

2. The assemblage of claim 1 wherein said plasticizer is diethylene glycol dibenzoate, N-ethyl-o,p-toluene sulfamide, ethylene glycol dibenzoate, dimethyl phthalate, t-butyl phenyl diphenyl phosphate, or dipropylene glycol dibenzoate.

3. The assemblage of claim 1 wherein said acidic material is a polyester ionomer comprising a polyester backbone containing units of a salt of a sulfonic acid or sulfonimide and a basic nitrogen-containing compound which has a pKa of its conjugate acid in the range from about 6 to about 10.

4. The assemblage of claim 3 wherein said polyester ionomer has the following formula:

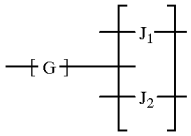

wherein:

G is the residue of one or more diol components which together comprise 100 mole % of recurring units and is represented by the following structure:

$$—O—(CHR_4CHR_5DB_1)_p—R_6—(OCHR_4CHR_5)_q—O—$$

wherein:

p and q each independently represents an integer from 0–4; $R_6$ represents an alkylene group of 1 to about 16 carbon atoms; a cycloalkylene group of 5 to about 20 carbon atoms; a cyclobisalkylene group of about 8 to about 20 carbon atoms; a bi- or tri-cycloaklene group of about 7 to about 16 carbon atoms; a bi- or tri-cyclobisalkylene group of about 9 to about 18 carbon atoms, an arenebisalkylene group of from 8 to about 20 carbon atoms, or an arylene group of 6 to about 12 carbon atoms; and $R_4$ and $R_5$ each independently represents H, a substituted or unsubstituted alkyl group of about 1 to about 6 carbon atoms, or a substituted or unsubstituted aryl group of about 6 to about 12 carbon atoms;

$B_1$ represents O or S;

$J_1$ represents the residue of a diacid component which comprises 8 to 30 mole % of recurring units and is represented by one or more of the following structures:

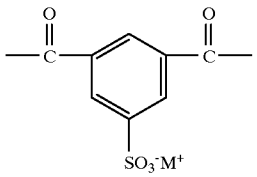

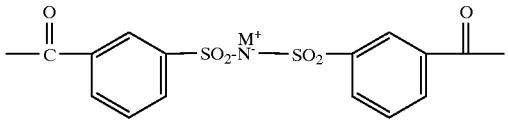

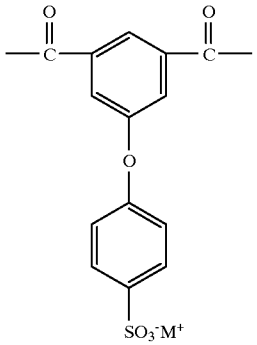

-continued

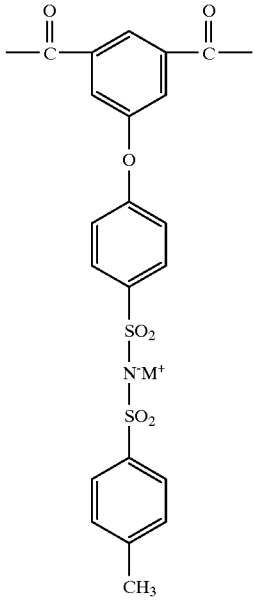

wherein:

$M^+$ represents the protonated or conjugate acid form of a basic, nitrogen-containing moiety having a pKa measured in water of from about 6 to about 10; and $J_2$ represents the residue of a diacid component which comprises 70 to 92 mole % of recurring units and is represented by one or more of the following structures:

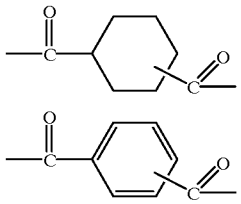

or

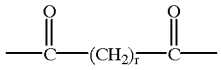

where r represents an integer from 2 to 10.

5. The assemblage of claim 1 wherein said polymer having a Tg of less than about 19° C. is an acrylic polymer, a styrene polymer, a polyester or a vinyl polymer.

6. The assemblage of claim 1 wherein said deprotonated cationic dye has the following formula:

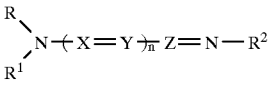

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

7. A process of forming a dye transfer image comprising imagewise-heating a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and imagewise transferring said dye to a dye-receiving element to form said dye transfer image, said dye-receiving element comprising a support having thereon a polymeric dye image-receiving layer, said polymeric dye image-receiving layer mixture of a) a polymer having a Tg of less than about 19° C. and having no or only slight acidity; and b) an acidic material containing at least 0.0007 meq/$m^2$ of acid; said a) and/or b) having incorporated therein a plasticizer containing:

(i) at least the following groups in the order given:

E—Q—X—A wherein Q is a carbonyl or sulfonyl;

X is N or O;

E is an aromatic ring; and

A is an alkyl or oxyalky group having up to 5 consecutive carbon atoms; or (ii) a phosphate group having at least one aromatic ring attached thereto;

said plasticizer being present in an amount of up to about 25 weight percent of the polymer.

8. The process of claim 7 wherein said plasticizer is diethylene glycol dibenzoate, N-ethyl-o,p-toluene sulfamide, ethylene glycol dibenzoate, dimethyl phthalate, t-butyl phenyl diphenyl phosphate, or dipropylene glycol dibenzoate.

9. The process of claim 7 wherein said acidic material is a polyester ionomer comprising a polyester backbone containing units of a salt of a sulfonic acid or sulfonimide and a basic nitrogen-containing compound which has a pKa of its conjugate acid in the range from about 6 to about 10.

10. The process of claim 9 wherein said polyester ionomer has the following formula:

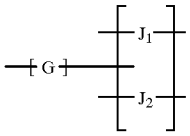

wherein:

G is the residue of one or more diol components which together comprise 100 mole % of recurring units and is represented by the following structure:

$$—O—(CHR_4CHR_5DB_1)_p—R_6—(OCHR_4CHR_5)_q—O—$$

wherein:

p and q each independently represents an integer from 0–4; $R_6$ represents an alkylene group of 1 to about 16 carbon atoms; a cycloalkylene group of 5 to about 20 carbon atoms; a cyclobisalkylene group of about 8 to about 20 carbon atoms; a bi- or tri-cycloalkylene group of about 7 to about 16 carbon atoms; a bi- or tri-cyclobisalkylene group of about 9 to about 18 carbon atoms, an arenebisalkylene group of from 8 to about 20 carbon atoms, or an arylene group of 6 to about 12 carbon atoms; and $R_4$ and $R_5$ each independently represents H, a substituted or unsubstituted alkyl group of about 1 to about 6 carbon atoms, or a substituted or unsubstituted aryl group of about 6 to about 12 carbon atoms;

$B_1$ represents O or S;

$J_1$ represents the residue of a diacid component which comprises 8 to 30 mole % of recurring units and is represented by one or more of the following structures:

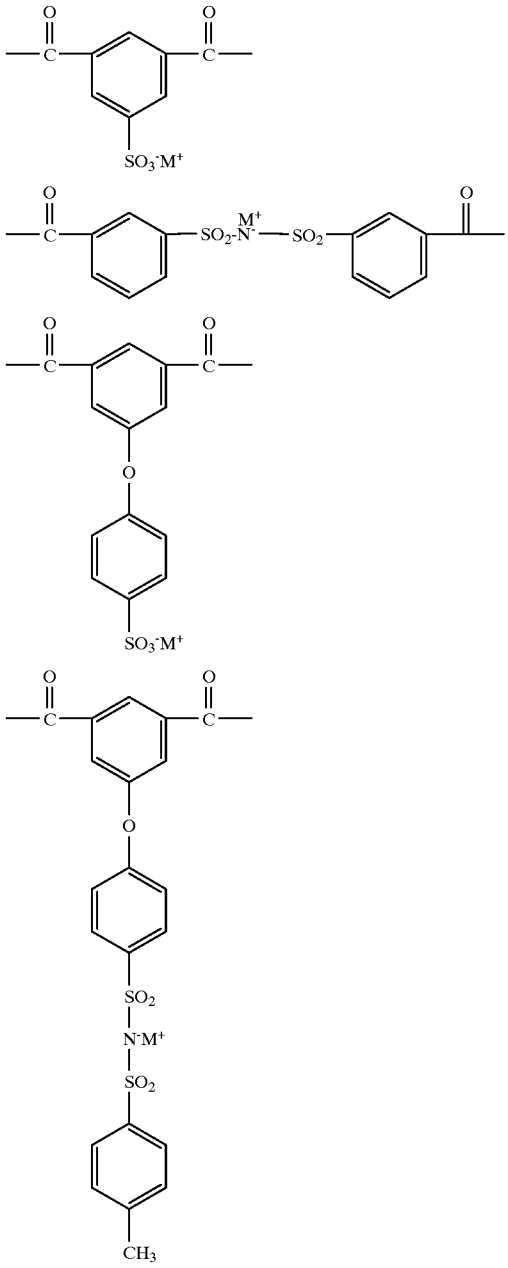

wherein:

$M^+$ represents the protonated or conjugate acid form of a basic, nitrogen-containing moiety having a pKa measured in water of from about 6 to about 10; and $J_2$ represents the residue of a diacid component which comprises 70 to 92 mole % of recurring units and is represented by one or more of the following structures:

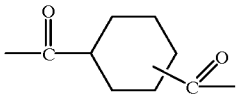

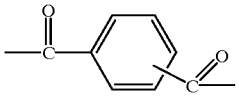

or

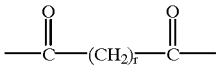

where r represents an integer from 2 to 10.

11. The process of claim 7 wherein said polymer having a Tg of less than about 19° C. is an acrylic polymer, a styrene polymer, a polyester or a vinyl polymer.

12. The process of claim 7 wherein said deprotonated cationic dye has the following formula:

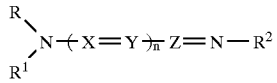

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

* * * * *